US010698435B1

(12) United States Patent
Boivin

(10) Patent No.: US 10,698,435 B1
(45) Date of Patent: Jun. 30, 2020

(54) ELECTRONIC CURRENT EQUALIZATION MODULE, CURRENT MIRROR CIRCUIT AND METHOD OF ASSEMBLING A CURRENT MIRROR CIRCUIT

(71) Applicant: GROUPE VARITRON INC., Longueuil (CA)

(72) Inventor: Pierre Boivin, Ile-Bizard (CA)

(73) Assignee: GROUPE VERITRON INC., St-Hubert (CA)

( * ) Notice: Subject to any disclaimer, the term of this patent is extended or adjusted under 35 U.S.C. 154(b) by 0 days.

(21) Appl. No.: 16/409,110

(22) Filed: May 10, 2019

(51) Int. Cl.
*G05F 3/26* (2006.01)
*H05B 45/46* (2020.01)

(52) U.S. Cl.
CPC ..... *G05F 3/262* (2013.01); *H05B 45/46* (2020.01)

(58) Field of Classification Search
CPC ..... G05F 3/262; H05B 33/0827
See application file for complete search history.

(56) References Cited

U.S. PATENT DOCUMENTS

| | | | | |
|---|---|---|---|---|
| 7,705,658 | B2 * | 4/2010 | Yamamoto | G01R 21/12 327/478 |
| 8,829,884 | B2 | 9/2014 | Zhong et al. | |
| 9,829,905 | B2 | 11/2017 | Mitchell et al. | |
| 2007/0222391 | A1 | 9/2007 | Lee et al. | |
| 2016/0318478 | A1 * | 11/2016 | Morimoto | B60R 25/34 |

* cited by examiner

*Primary Examiner* — Adolf D Berhane
*Assistant Examiner* — Afework S Demisse
(74) *Attorney, Agent, or Firm* — BCF LLP

(57) ABSTRACT

The present disclosure relates to an electronic current equalization module that comprises a transistor having a collector, a base and an emitter. The module also comprises an input port, a ground port electrically connected to the emitter, a collector port electrically connected to the collector, a base port electrically connected to the base, and a non-linear device electrically connected between the input port and the collector. A current mirror circuit comprising a first module configured as a reference module and one or more second modules configured as follower modules is disclosed. A method of assembling a current mirror circuit is also disclosed.

9 Claims, 9 Drawing Sheets

ELECTRONIC CURRENT EQUALIZATION MODULE, CURRENT MIRROR CIRCUIT AND METHOD OF ASSEMBLING A CURRENT MIRROR CIRCUIT

TECHNICAL FIELD

The present disclosure relates to the field of electronic circuits. More specifically, the present disclosure relates to an electronic current equalization module, a current mirror circuit constructed by assembling electronic current equalization modules, and a method of assembling the current mirror circuit.

BACKGROUND

Current mirror circuits are in common use and attempt to equalize current levels between a plurality of parallel loads. FIG. 1 (Prior Art) is an example of a conventional current mirror circuit. A circuit 10 comprises a current source 12, a primary branch 14 and a secondary branch 16. The primary branch 14 includes a load consisting of ten (10) light emitting diodes (LED), LED1 to LED10, connected to a collector and to a base of a bipolar transistor Q1. The secondary branch 16 includes a load consisting of ten (10) other LEDs, LE11 to LED20, connected to a collector of another bipolar transistor Q2. A base of the transistor Q2 is connected to the collector of the transistor Q1. Emitters of the transistors Q1 and Q2 are connected to a common ground (GND). A current I0 flowing from the current source 12 is split into currents I1 and I2 that respectively flow in the primary branch 14 and in the secondary branch 16. The currents I1 and I2 also respectively flow through the transistors Q1 and Q2 and return to a ground (GND) connection of the current source 12.

The connection of the base of the transistor Q2 to the collector of the transistor Q1 is intended to equalize magnitudes of the currents I1 and I2. The skilled reader will readily appreciate that the circuit 10 may fail to ensure that the currents I1 and I2 are perfectly equal, as may be the case when the base to emitter voltage of the transistor Q1 is not equal to the base to emitter voltage of the transistor Q2.

FIG. 2 (Prior Art) is another example of a conventional current mirror circuit. A circuit 20 includes the same current source 12, the primary branch 14 and the secondary branch 16. The circuit 20 also includes further secondary branches 22, 24, 26 and 28 that respectively include loads formed of LED21 to LED30, LED31 to LED40, LED41 to LED50 and LED51 to LED60. The secondary branches 22, 24, 26 and 28 also respectively include transistors Q3, Q4, Q5 and Q6. The current I0 from the current source I2 is split into currents I1, I2, I3, I4, I5 and I6 flowing through the branches 14, 16, 22, 24, 26 and 28. Bases of the transistors Q3, Q4, Q5 and Q6 are also connected to the collector of the transistor Q1, so that the currents I1-I6 are intended to have substantially equal magnitudes.

FIG. 3 (Prior Art) is a further example of a conventional current mirror circuit. A circuit 30 differs from the circuit 20 in that, in branches 34, 36, 38, 40, 42 and 44, feedback resistors R1, R2, R3, R4, R5 and R6 are respectively connected between emitters of the transistors Q1, Q2, Q3, Q4, Q5 and Q6 and the common ground (GND). The presence of the feedback resistors R1 to R6 tends to mitigate variations of base to emitter voltages between the transistors Q1 to Q6. Generally, the feedback resistors R1 to R6 have substantially the same value.

In FIGS. 1, 2 and 3, the loads as illustrated consist of LEDs. Current mirrors may also be used to equalize currents between many other types of loads.

A problem with conventional current mirrors as illustrated in FIGS. 1, 2 and 3 is that current equalization is far from being perfect, particularly when current varies over time. Current imbalances may persist when using any one of the circuits 10, 20 or 30.

Therefore, there is a need for improvements that compensate for problems related to potential current imbalances in current mirror circuits.

SUMMARY

According to the present disclosure, there is provided an electronic current equalization module. The module comprises a transistor, a non-linear device, and four (4) ports. The transistor has a collector, a base and an emitter. The ports include an input port, a ground port electrically connected to the emitter, a collector port electrically connected to the collector, and a base port electrically connected to the base. The non-linear device is electrically connected between the input port and the collector.

According to the present disclosure, there is also provided a current mirror circuit. The circuit comprises a first electronic current equalization module configured as a reference module having its input port connected to an output of a primary load and having a short-circuit connection mounted between its collector port and its base port. The circuit also comprises one or more second electronic current equalization modules. Each second electronic current equalization module is configured as a follower module having its respective input port connected to the output of a respective secondary load and having its respective base port connected to the collector port of the first electronic current equalization module.

The present disclosure further relates to a method of assembling a current mirror circuit. An input of a primary load is connected to an output of a current source. An output of the primary load is connected to the input port of a first electronic current equalization module. A short-circuit connection is mounted between the collector port and the base port of the first electronic current equalization module. Input ports of one or more secondary loads are connected to the output of the current source. Outputs of each of the one or more secondary loads are connected to the collector port of a corresponding one of one or more second electronic current equalization modules. The base ports of each of the second electronic current equalization modules are connected to the collector port of the first electronic current equalization module. The ground ports of the first electronic current equalization module and of each of the second electronic current equalization modules are connected to a ground connection of the current source.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Various aspects of the present disclosure generally address one or more of the problems related to potential current imbalances in current mirror circuits.

Generally speaking, an electronic current equalization module can be configured for use as a reference module or as a follower module. Such modules can be assembled to form a current mirror circuit having one reference module and a plurality of follower modules. In an embodiment, the reference module and the follower modules may all share an identical construction, being configured to achieve their respective functions by a manner in which they are assembled within the current mirror circuit.

The electronic current equalization module may be provided in a large range of sizes and current handling capabilities, ranging from milliamperes for some applications to tens of amperes for some other applications.

Figure 4:
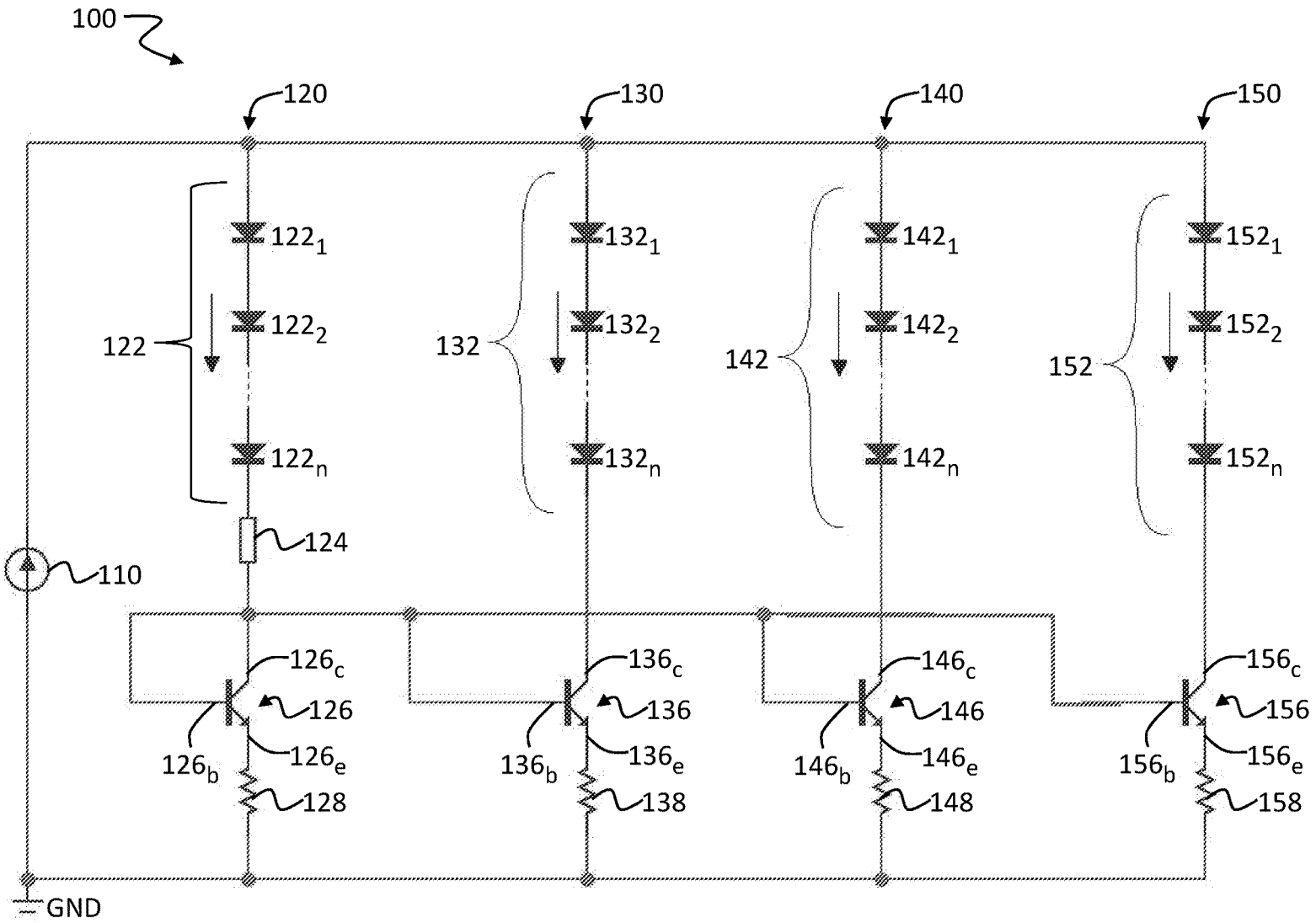
FIG. 4 is a schematic diagram of a current mirror circuit according to an embodiment of the present technology.

Referring now to the drawings, FIG. 4 is a schematic diagram of a current mirror circuit according to an embodiment of the present technology. A current mirror circuit 100 includes a current source 110, a primary branch 120 and a plurality of secondary branches 130, 140 and 150; although four (4) branches are illustrated, the current mirror circuit 100 may include two (2) or more branches, including one (1) primary branch and any number of secondary branches.

The primary branch 120 includes a load 122 that, in the illustrated non-limiting embodiment, includes LEDs $\mathbf{122}_1$, $\mathbf{122}_2$ . . . $\mathbf{122}_n$. The primary branch 120 also includes a non-linear device 124 and a bipolar transistor 126 having a collector $\mathbf{126}_c$, a base $\mathbf{126}_b$ and an emitter $\mathbf{126}_e$. A feedback resistor 128 completes the primary branch 120.

A secondary branch 130 includes a load 132 that, in the illustrated non-limiting embodiment, includes LEDs $\mathbf{132}_1$, $\mathbf{132}_2$ . . . $\mathbf{132}_n$. The secondary branch 130 also includes a bipolar transistor 136 having a collector $\mathbf{136}_c$, a base $\mathbf{136}_b$ and an emitter $\mathbf{136}_e$. A feedback resistor 138 completes the secondary branch 130. Another secondary branch 140 includes a load 142 that, in the illustrated non-limiting embodiment, includes LEDs $\mathbf{142}_1$, $\mathbf{142}_2$ . . . $\mathbf{142}_n$. The secondary branch 140 also includes a bipolar transistor 146 having a collector $\mathbf{146}_c$, a base $\mathbf{146}_b$ and an emitter $\mathbf{146}_e$. A feedback resistor 148 completes the secondary branch 140. Yet another secondary branch 150 includes a load 152 that, in the illustrated non-limiting embodiment, includes LEDs $\mathbf{152}_1$, $\mathbf{152}_2$ . . . $\mathbf{152}_n$. The secondary branch 150 also includes a bipolar transistor 156 having a collector $\mathbf{156}_c$, a base $\mathbf{156}_b$ and an emitter $\mathbf{156}_e$. A feedback resistor 158 completes the secondary branch 150.

Figure 1:
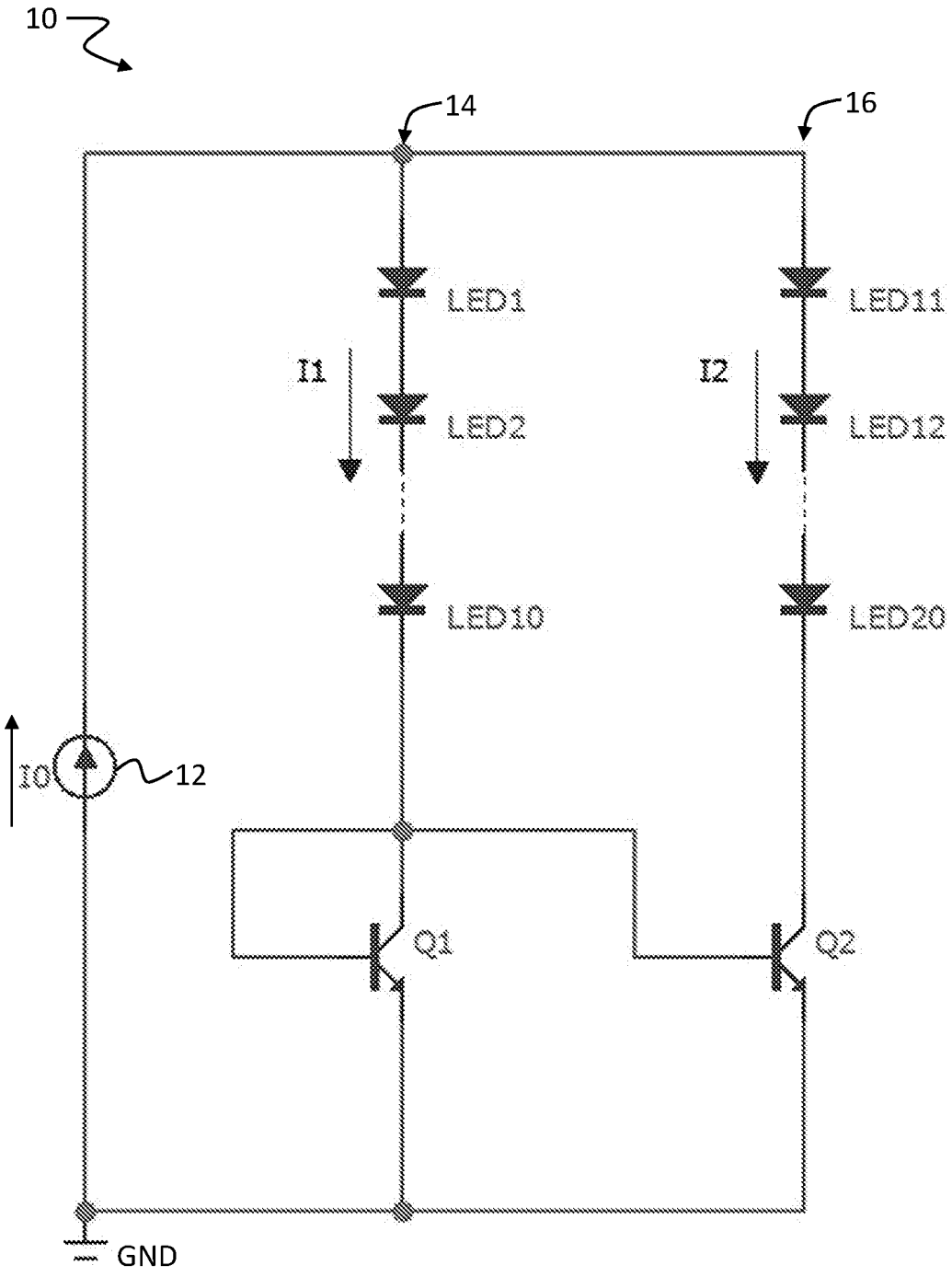
Figure 1 (Prior Art)
FIG. 1 (Prior Art) is an example of a conventional current mirror circuit.
Figure 2:
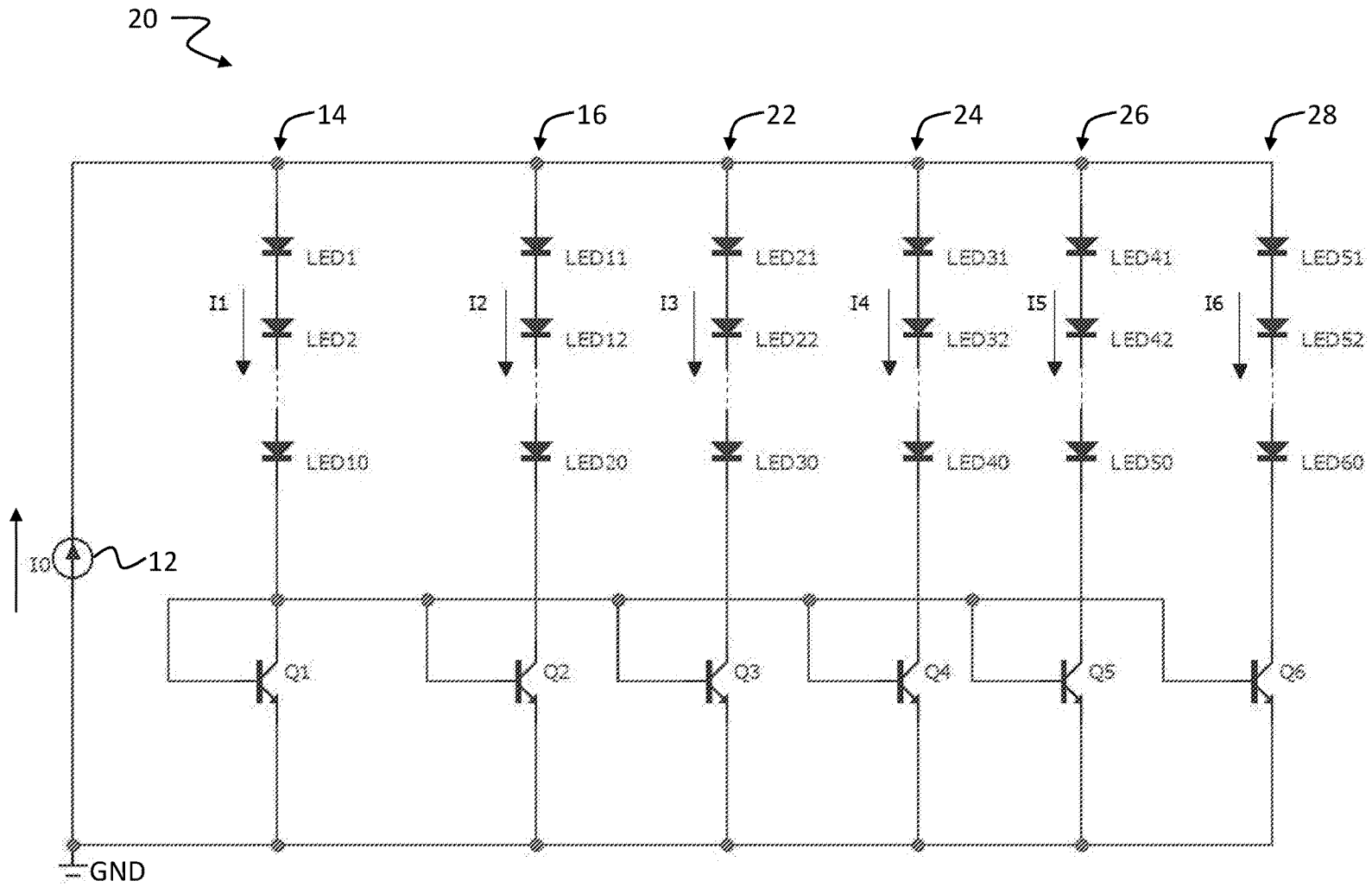
Figure 2 (Prior Art)
FIG. 2 (Prior Art) is another example of a conventional current mirror circuit.
Figure 3:
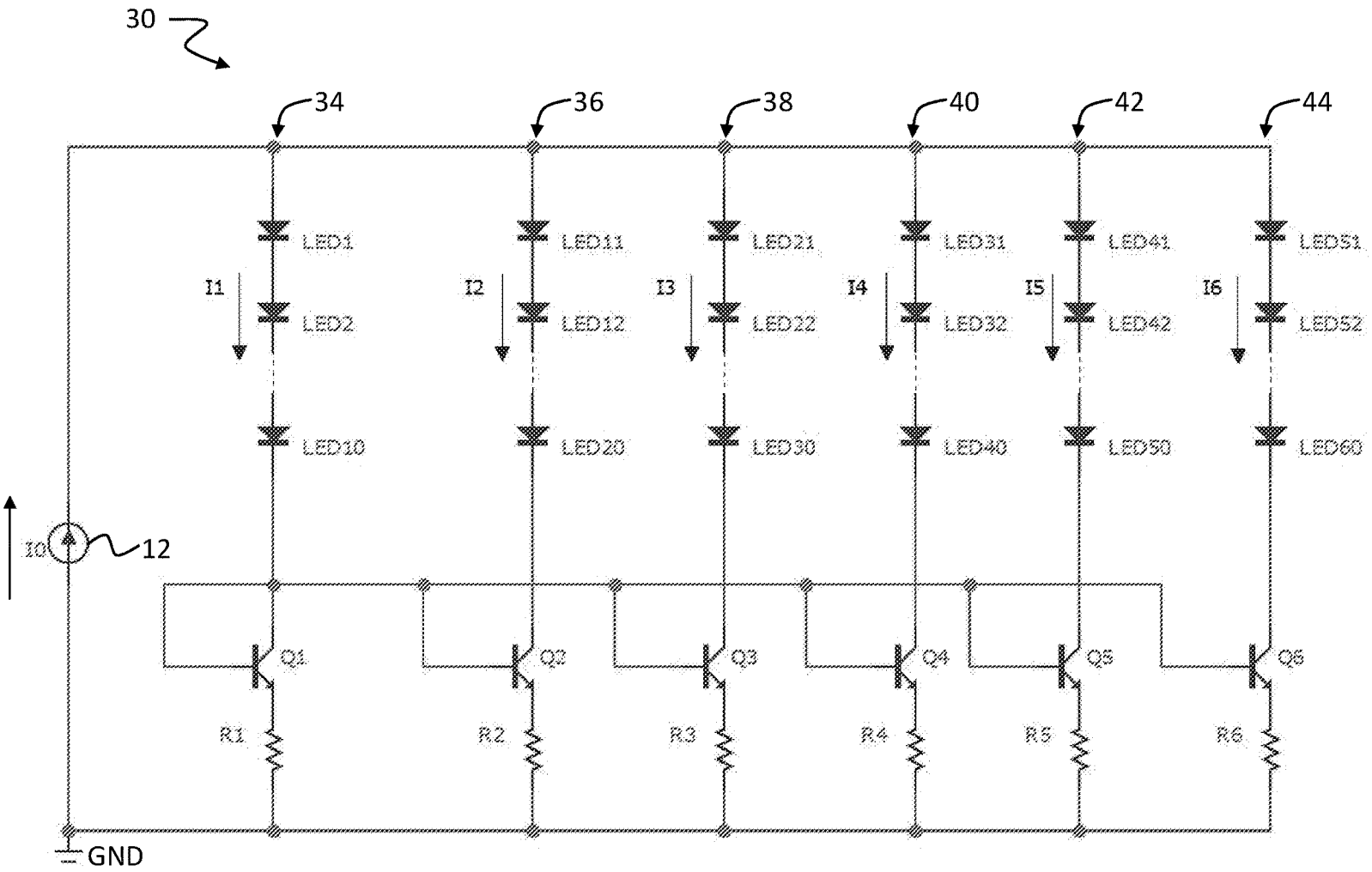
Figure 3 (Prior Art)
FIG. 3 (Prior Art) is a further example of a conventional current mirror circuit.

In the primary branch 120, the non-linear device 124 is connected between the load 122 and the collector 126. The base $\mathbf{126}_b$ is also connected to the collector $\mathbf{126}_c$. In the secondary branches, the loads 132, 142 and 152 are respectively connected directly to the collectors $\mathbf{136}_c$, $\mathbf{146}_c$, and $\mathbf{156}_c$, the respective bases $\mathbf{136}_b$, $\mathbf{146}_b$, and $\mathbf{156}_b$ being connected to the collector $\mathbf{126}_c$ of the transistor 126 of the primary branch 120. The circuit 100 therefore differs from the circuit 30 of FIG. 3 primarily by the presence of the non-linear device 124 between the load 122 and the collector $\mathbf{126}_c$ of the transistor 126.

The current mirror circuit 100 of FIG. 4 attempts to equalize currents flowing through the primary and secondary branches 120, 130, 140 and 150. Assuming that the loads 122, 132, 142 and 152 are of substantially identical impedance, a voltage drop across the load 122 and the non-linear device 124 becomes slightly greater than voltage drops across the loads 132, 142 and 152, respectively. This maintains voltages at the bases $\mathbf{136}_b$, $\mathbf{146}_b$, and $\mathbf{156}_b$ of the transistors 136, 146 and 156 slightly lower than voltages at the collectors $\mathbf{136}_c$, $\mathbf{146}_c$, and $\mathbf{156}_c$ of these transistors 136, 146 and 156. Accordingly, collector to base voltages in these transistors 136, 146 and 156 are slightly positive to mitigate any difference between currents flowing through the various branches.

In FIG. 4 and in later Figures, the non-linear device 124 may comprise, in non-limiting examples, a diode, a metal oxide varistor (MOV), a negative temperature coefficient (NTC) thermistor, a positive temperature coefficient (PTC) thermistor, a metal-oxide-semiconductor field-effect (MOSFET) transistor, and the like. Some of the later Figures illustrate the non-linear device 124 in the form of a diode for simplicity purposes and without limiting the generality of the present disclosure. Use of a variety of different types of non-linear devices is also contemplated.

The current mirror circuit 100 as illustrated includes three (3) secondary branches 130, 140 and 150. In other embodiments, the current mirror circuit 100 may include other number of secondary branches, including one or more secondary branches. Although the loads 122, 132, 142 and 152 as illustrated comprise LEDs, other types of loads are contemplated, including loads that consume currents varying from milliamperes to tens of amperes.

Figure 5:
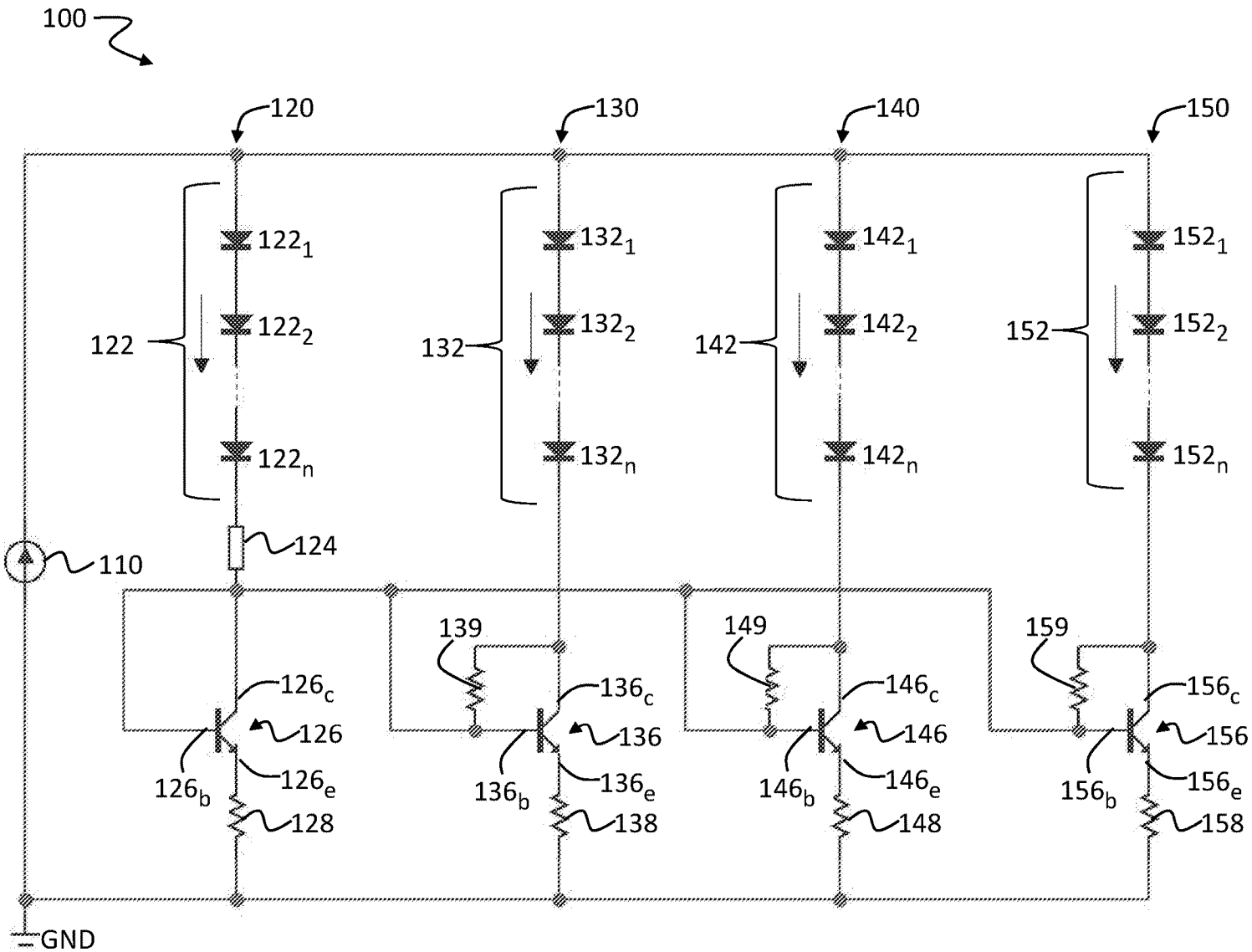
FIG. 5 is a schematic diagram of another current mirror circuit according to an embodiment of the present technology.

FIG. 5 is a schematic diagram of another current mirror circuit according to an embodiment of the present technology. FIG. 5 illustrates a variant of the current mirror circuit 100 in which a protection resistor 139, 149, 159 is inserted, respectively, between the collector and the base of the transistors 136, 146, 156 of each of the secondary branches 130, 140 and 150. In an event where any one of the transistors 136, 146 or 156 loses the connection of its base $\mathbf{136}_b$, $\mathbf{146}_b$ or $\mathbf{156}_b$ to the collector 126 of the transistor 126, a voltage drop across the protection resistor 139, 149 or 159 will allow to maintain polarization of the transistor 136, 146 or 156, preventing an erratic current behavior due to floating of the base $\mathbf{136}_b$, $\mathbf{146}_b$ or $\mathbf{156}_b$.

Figure 6:
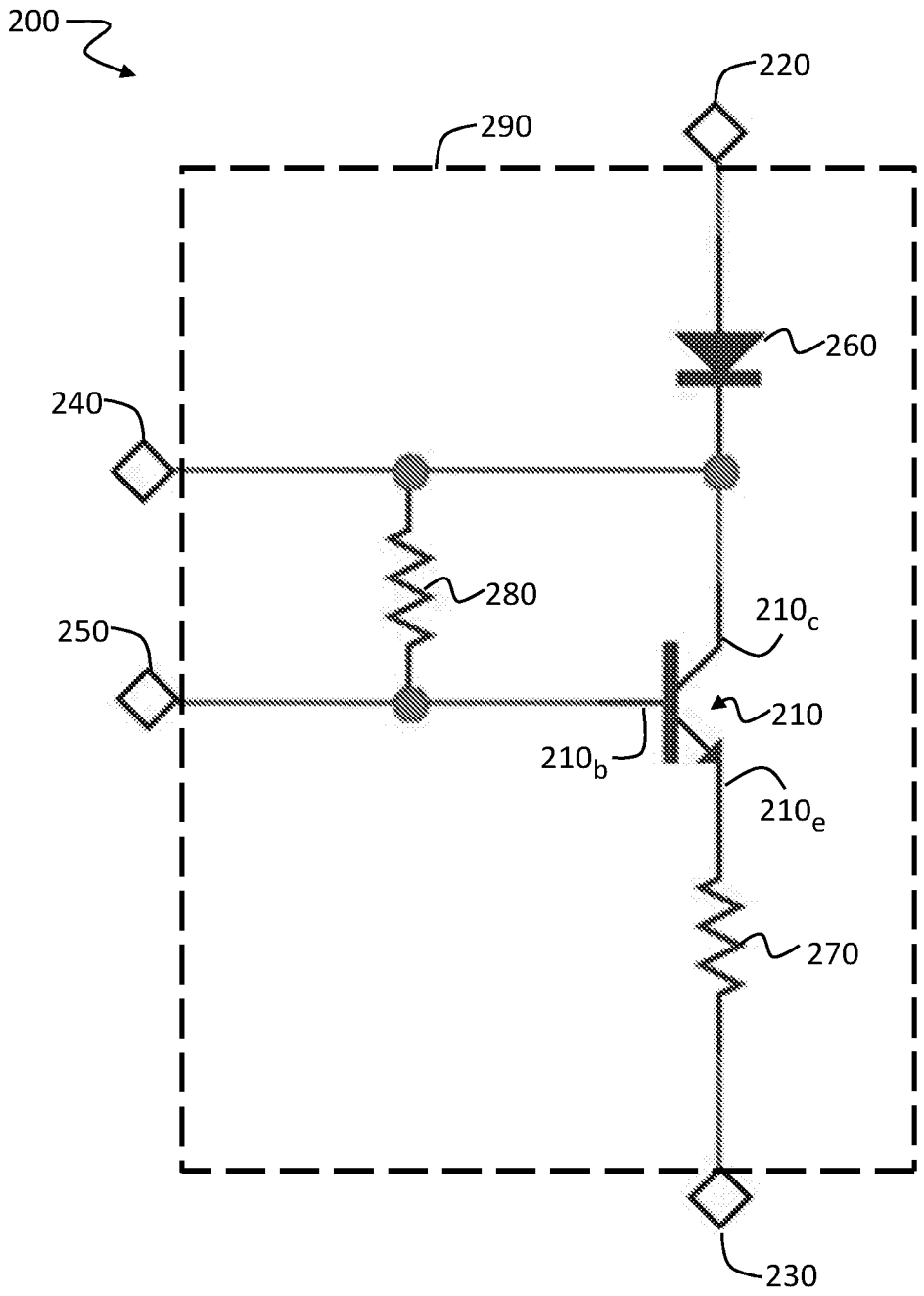
FIG. 6 schematic diagram of an electronic current equalization module according to an embodiment of the present technology.

The current mirror circuit 100 may be constructed from discrete components. However, in an embodiment, a current mirror circuit may be constructed by assembling a plurality of electronic current equalization modules, a first module being configured as a reference module, one or more additional modules being configured as follower modules. FIG. 6 schematic diagram of an electronic current equalization module according to an embodiment of the present technology. An electronic current equalization module 200 comprises a transistor 210 having a collector $\mathbf{210}_c$, a base $\mathbf{210}_b$ and an emitter $\mathbf{210}_e$. The module 200 also comprises an input port 220, a ground port 230 electrically connected to the emitter $\mathbf{210}_e$, a collector port 240 electrically connected to the collector $\mathbf{210}_c$, a base port 250 electrically connected to the base $\mathbf{210}_b$, and a non-linear device 260 electrically connected between the input port 220 and the collector $\mathbf{210}_c$. In the non-limiting embodiment of FIG. 6, the non-linear device 260 is a diode. As expressed hereinabove, use of other types of non-linear devices 260 is also contemplated. In the module 200, the emitter $\mathbf{210}_e$ may be directly connected to the ground port 230. In a variant, the module 200 may also comprise a feedback resistor 270 connected between the emitter $\mathbf{210}_e$ and the ground port 230. In the same or another variant, the module 200 may also a protection resistor 280 connected between the collector $\mathbf{210}_c$ and the base $\mathbf{210}_b$. Optionally, the module 200 may comprise a casing 290 that encloses the transistor 210, the non-linear device 260, the feedback resistor 270 and the protection resistor 280 so that only the input port 220, the ground port 230, the collector port 240 and the base port 250 are exposed and accessible for connection to external devices. The casing may for example be constructed as a permanent seal.

Figure 7C:
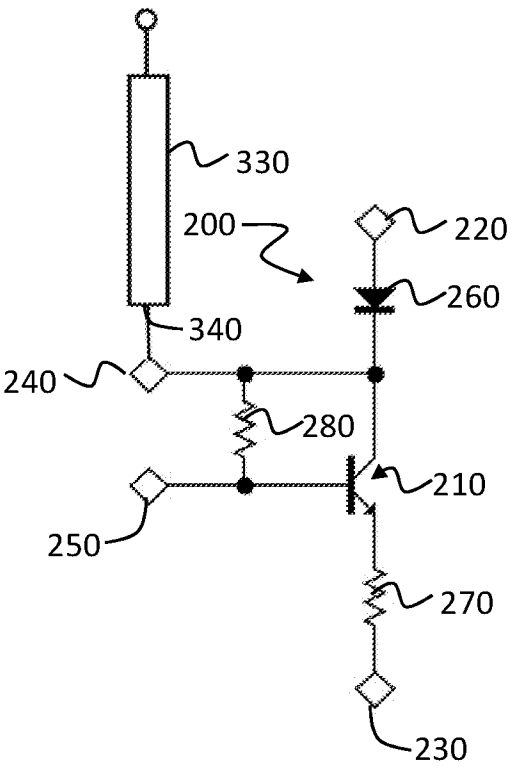
FIGS. 7*a*, 7*b* and 7*c* illustrate configuration examples for the electronic current equalization module of FIG. 6.
Figure 7B:
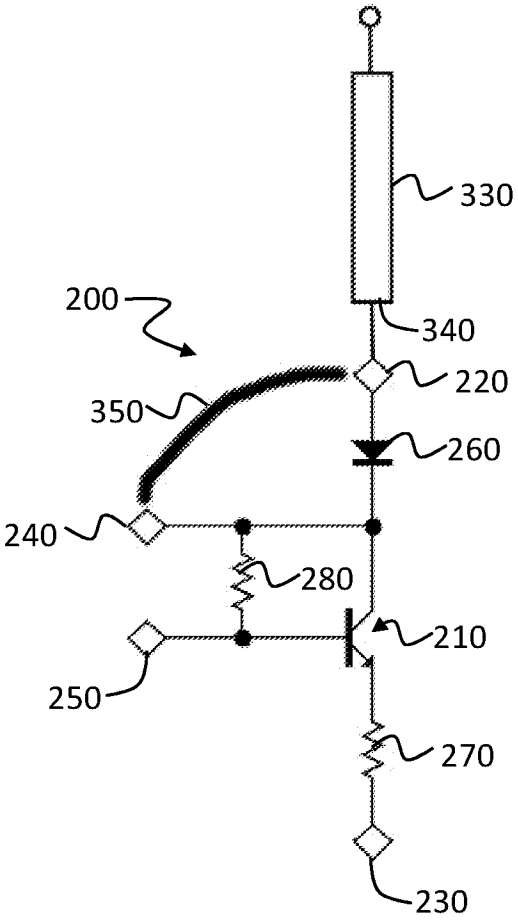
Figure 7A:
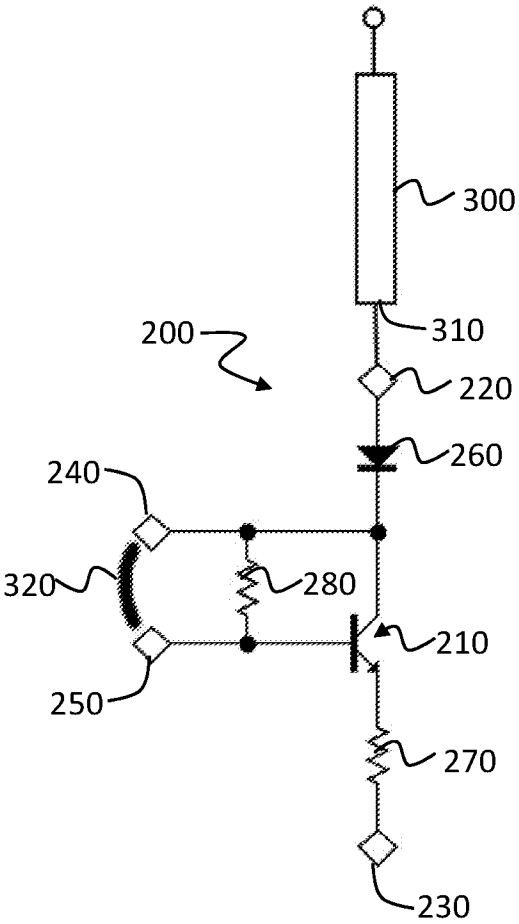

FIGS. 7*a*, 7*b* and 7*c* illustrate configuration examples for the electronic current equalization module of FIG. 6. Considering FIG. 7*a*, the module 200 of FIG. 6 may be configured as a reference module for use in constructing a current mirror circuit by connecting an output 310 of a primary load 300 to the input port 220 and by mounting a short-circuit connection 320 between the collector port 240 and the base port 250 of the module 200. Thus configured, the module 200 along with the primary load 300 may form the primary branch 120 of the current mirror circuit 100 of FIG. 5.

Considering then FIGS. 7*b* and 7*c*, the module 200 may be configured as a follower module by connecting an output 340 of a secondary load 330 to the collector port 240 (FIG. 7*c*). The module 200 may alternatively be configured as a follower module by connecting the output 340 of the secondary load 330 to the input port 220, as in FIG. 7*a*, also adding a short-circuit connection 350 between the input port 220 and the collector port 240 (FIG. 7*b*). In the particular case of FIG. 7*b*, the short-circuit connection 350 is effectively placed in parallel with the non-linear device 260 so that the module 200 operates as if the non-linear device 260 was not present. The module 200 configured as shown in either of FIG. 7*b* or 7*c* along with the secondary load 330 may form any of the secondary branches 130, 140 and/or 150 of the current mirror circuit of FIG. 5, the base port 250 of the module 200 in each secondary branch being connected to the collector port 240 of the module 200 in the primary branch.

Either one of configuration shown on FIG. 7*b* or 7*c* may be selected when assembling a current mirror circuit using the modules 200, according to a circuit designer's preferences.

Figure 8:
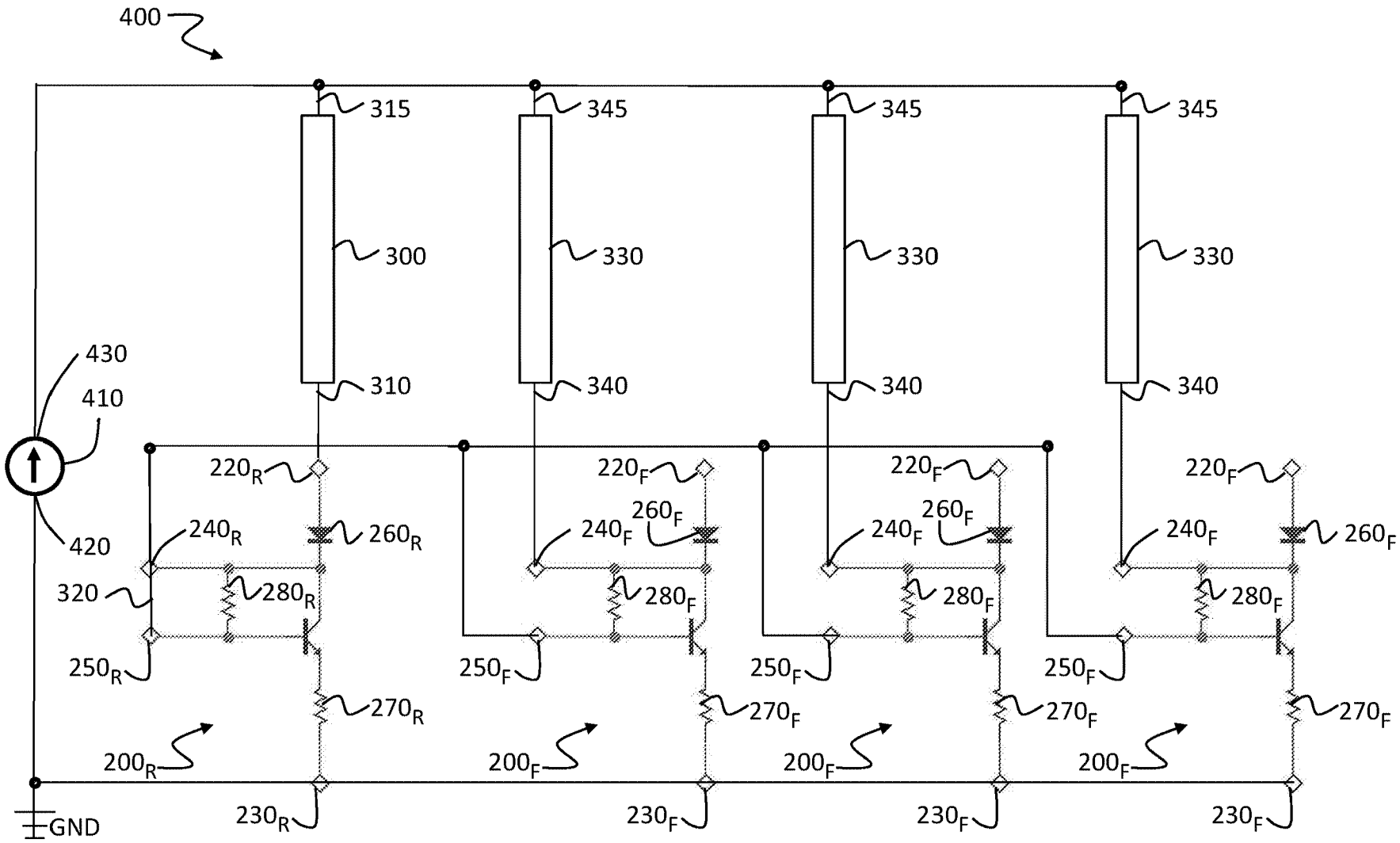
FIG. 8 is a schematic diagram of yet another current mirror circuit constructed from electronic current equalization modules as introduced in FIG. 6.

FIG. 8 is a schematic diagram of yet another current mirror circuit constructed from electronic current equalization modules as introduced in FIG. 6. A current mirror circuit 400 comprises a first electronic current equalization module $\mathbf{200}_R$ configured as a reference module having its input port $\mathbf{220}_R$ connected the output 310 of the primary load 300. The circuit 400 also comprises one or more second electronic current equalization modules $\mathbf{200}_F$ (three such modules $\mathbf{200}_F$ are illustrated) configured as follower modules and having their respective collector ports $\mathbf{240}_F$ connected to the outputs 340 of respective secondary loads 330 and having their respective base ports $\mathbf{250}_E$ connected to the collector port $\mathbf{240}_R$ of the first electronic current equalization module $\mathbf{200}_R$.

A short-circuit connection 320 is mounted between the collector port $\mathbf{240}_R$ and the base port $\mathbf{250}_R$ of the first electronic current equalization module $\mathbf{200}_R$, effectively shunting the protection resistor 280 (identified on FIGS. 7*a*-7*c*). Also, although not illustrated on FIG. 8, in each of the second electronic current equalization modules $\mathbf{200}_F$, a short-circuit connection 350 (FIG. 7*b*) may be provided between the collector port $\mathbf{240}_F$ of the input port $\mathbf{220}_F$ so that the output 340 of the respective secondary load 330 may be directly connected to the input port $\mathbf{220}_F$, being effectively connected to the collector port $\mathbf{240}_F$ via the short-circuit connection.

The first electronic current equalization module $\mathbf{200}_R$ includes a non-linear device $\mathbf{260}_R$, illustrated as a diode in the example of FIG. 8. Each of the second electronic current equalization modules $\mathbf{200}_F$ also includes a non-linear device $\mathbf{260}_F$ that is effectively inactive in the shown configuration.

The current mirror circuit 400 also comprises a current source 410. The current source 410 includes a ground connection 420 electrically connected to the ground port $\mathbf{230}_R$ of the first electronic current equalization module $\mathbf{200}_R$ and to the ground port $\mathbf{230}_F$ of each of the second electronic current equalization modules $\mathbf{200}_F$. The current source 410 also includes a current output 430 electrically connected to an input 315 of the primary load 310 and to inputs 345 of each of the respective secondary loads 330.

As illustrated in the non-limiting embodiment of FIG. 8, each of the electronic current equalization modules $\mathbf{200}_R$ and $\mathbf{200}_F$ may include a feedback resistor $\mathbf{270}_R$ and $\mathbf{270}_F$ and/or a protection resistor $\mathbf{280}_R$ and $\mathbf{280}_F$.

Figure 9:
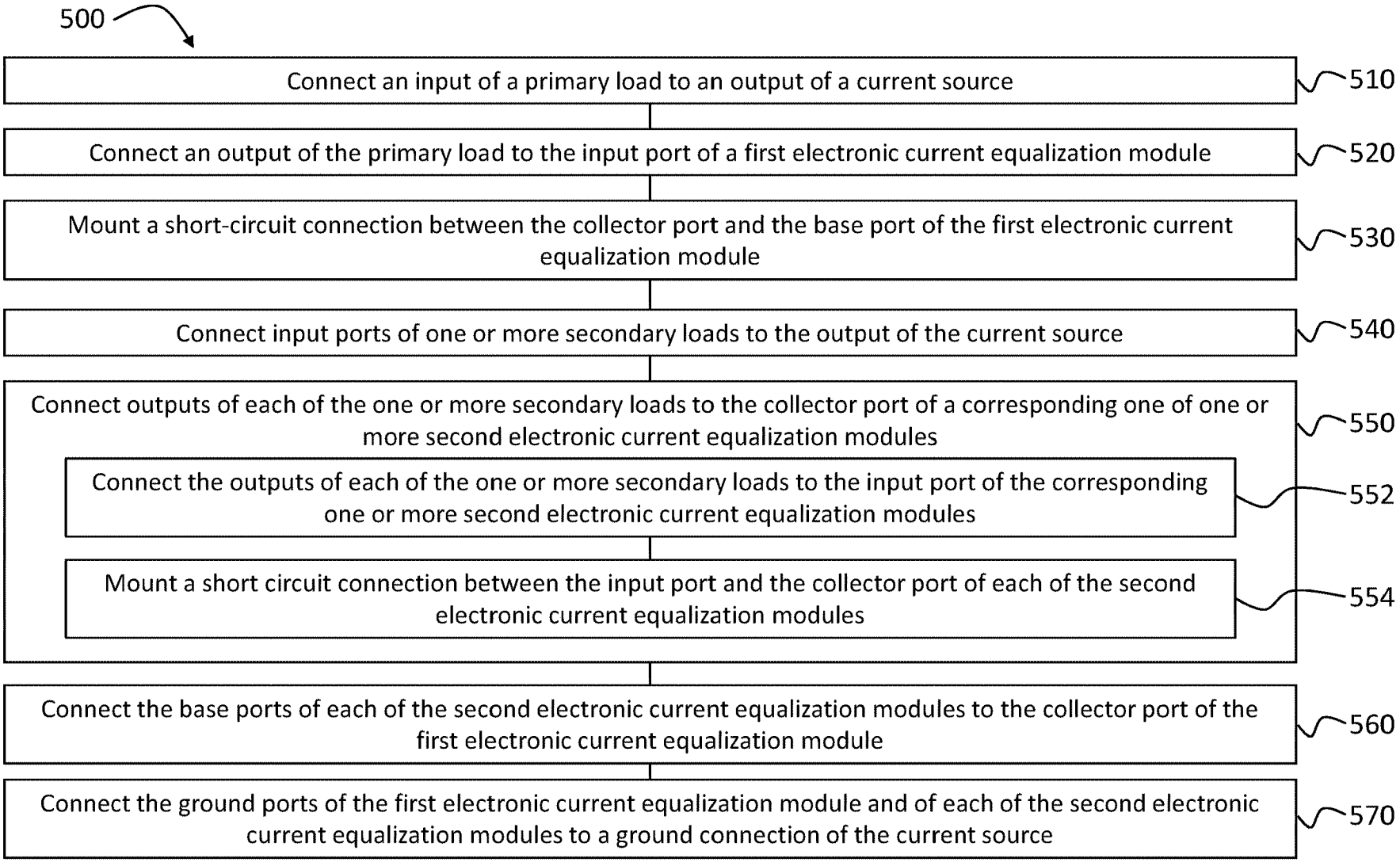
FIG. 9 is a sequence diagram showing operations of a method of assembling a current mirror circuit.

FIG. 9 is a sequence diagram showing operations of a method of assembling a current mirror circuit. In FIG. 9, a sequence 500 comprises a plurality of operations that may be executed in variable order, some of the operations possibly being executed concurrently, some of the operations being optional. At operation 510, the input 315 of the primary load 300 is connected to the output 430 of the current source 410. The output 310 of the primary load 300 is connected to the input port $\mathbf{220}_R$ of a first electronic current equalization module $\mathbf{200}_R$ at operation 520. A short-circuit connection 320 is mounted between the collector port $\mathbf{240}_R$ and the base port $\mathbf{250}_R$ of the first electronic current equalization module $\mathbf{200}_R$ at operation 530. The short-circuit connection 320 is thus placed in parallel to the protection resistor 280 of the first electronic current equalization module $\mathbf{200}_R$, which is therefore shunted in this first electronic current equalization module $\mathbf{200}_R$ that is acting as a reference module for the current mirror circuit 400. Operation 540 comprises connecting the input 345 of each of one or more secondary loads 330 to the output 430 of the current source 410. At operation 550, the output 340 of each of the one or more secondary loads 330 is connected to the collector port $\mathbf{240}_F$ of a corresponding one of one or more second electronic current equalization modules $\mathbf{200}_F$.

Optionally, operation 550 may comprise sub-operations 552 and 554. At sub-operation 552, the output 340 of each of the one or more secondary loads 330 may be connected to the input port $\mathbf{220}_F$ of the corresponding one or more second electronic current equalization modules $\mathbf{200}_F$. At sub-operation 554, a short-circuit connection 350 may be mounted between the input port $\mathbf{220}_F$ and the collector port $\mathbf{240}_F$ of each of the second electronic current equalization modules $\mathbf{200}_F$. Using the optional sub-operations 552 and 554, the secondary loads 330 are connected to the input port $220_F$ of the corresponding second electronic current equalization modules 200F in the same manner as the primary load 300 which is connected to the input port $220_R$ of the first electronic current equalization module $200_R$, this being compensated with the addition of the short-circuit connections 350. This particular set-up may simplify the assembly of the current mirror circuit 400 and mitigate potential risks of assembly errors. The skilled reader will appreciate that the short-circuit connections 350 being effectively placed in parallel to the non-linear devices $260_F$, the second electronic current equalization modules $200_F$ operate as if the non-linear devices $260_F$ were not present.

Regardless, the base ports $250_E$ of each of the second electronic current equalization modules $200_F$ is connected to the collector port $240_R$ of the first electronic current equalization module $200_R$ at operation 560. The ground port $230_R$ of the first electronic current equalization module $200_R$ and the ground port $230_F$ of each of the second electronic current equalization modules $200_F$ are connected to the ground connection 420 of the current source 410 at operation 570.

Those of ordinary skill in the art will realize that the description of the electronic current equalization module, current mirror circuit and method for assembling a current mirror circuit are illustrative only and are not intended to be in any way limiting. Other embodiments will readily suggest themselves to such persons with ordinary skill in the art having the benefit of the present disclosure. Furthermore, the disclosed module, circuit and method may be customized to offer valuable solutions to existing needs and problems related to potential current imbalances in current mirror circuits. In the interest of clarity, not all of the routine features of the implementations of the module, circuit and method are shown and described. In particular, combinations of features are not limited to those presented in the foregoing description as combinations of elements listed in the appended claims form an integral part of the present disclosure. It will, of course, be appreciated that in the development of any such actual implementation of the module, circuit and method, numerous implementation-specific decisions may need to be made in order to achieve the developer's specific goals, such as compliance with application-related, system-related, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of electronic circuits having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. A current mirror circuit, comprising:

a first electronic current equalization module, comprising:

a first transistor having a first collector, a first base and a first emitter, a first input port, a first ground port electrically connected to the first emitter, a first collector port electrically connected to the first collector, a first base port electrically connected to the first base, and a first non-linear device electrically connected between the first input port and the first collector;

wherein, the first electronic current equalization module is configured as a reference module by connecting an output of a primary load to the first input port and by mounting a first short-circuit connection between the first collector port and the first base port;

one or more second electronic current equalization modules, each of the one or more second electronic current equalization modules comprising:

a respective transistor having a respective collector, a respective base and a respective emitter, a respective input port, a respective ground port electrically connected to the respective emitter, a respective collector port electrically connected to the respective collector, a respective base port electrically connected to the respective base, and a respective non-linear device electrically connected between the respective input port and the respective collector;

wherein each of the one or more second electronic current equalization modules is configured as a respective follower module by (i) connecting an output of a respective secondary load to its respective collector port and (ii) by connecting its respective base port to the first collector port of the first electronic current equalization module configured as the reference module; and a current source including:

a ground connection electrically connected to the first ground port of the first electronic current equalization module and to the respective ground port of each of the second electronic current equalization modules; and a current output electrically connected to an input of the primary load and to inputs of each of the respective secondary loads.

2. The circuit of claim 1, wherein the first non-linear device is a diode.

3. The circuit of claim 1, further comprising:

a first casing enclosing the first transistor and the first non-linear device, the first casing being configured to allow external connections to the first input port, to the first ground port, to the first collector port and to the first base port; and one or more second casings, each second casing enclosing the respective transistor and the respective non-linear device of one of the one or more second electronic current equalization modules, each second casing being configured to allow external connections to the respective input port, to the respective ground port, to the respective collector port and to the respective base port.

4. The circuit of claim 1, wherein, in each of the second electronic current equalization modules, a respective short-circuit connection is provided between the respective collector port of the respective input port, the output of the respective secondary load being connected to the respective input port and being further connected to the respective collector port via the respective short-circuit connection.

5. The circuit of claim 1, wherein each of the second electronic current equalization modules comprises a respective protection resistor connected between its respective collector and base.

6. The circuit of claim 5, wherein the first electronic current equalization module comprises a first protection resistor connected between the first collector and the first base.

7. The circuit of claim 1, wherein each of the first electronic current equalization module and of the second electronic current equalization modules comprises a respective feedback resistor connected between its respective emitter and ground port.

8. A method of assembling a current mirror circuit, comprising:

connecting an input of a primary load to an output of a current source;

connecting an output of the primary load to the input port of a first electronic current equalization module, comprising:

a first transistor having a first collector, a first base and a first emitter, a first input port, a first ground port electrically connected to the first emitter, a first collector port electrically connected to the first collector, a first base port electrically connected to the first base, and a first non-linear device electrically connected between the first input port and the first collector;

mounting a first short-circuit connection between the first collector port and the first base port of the first electronic current equalization module;

connecting input ports of one or more respective secondary loads to the output of the current source;

connecting outputs of each of the one or more respective secondary loads to a respective collector port of a corresponding one of one or more second electronic current equalization modules, each of the one or more second electronic current equalization modules comprising:

a respective transistor having the respective collector, a respective base and a respective emitter, a respective input port, a respective ground port electrically connected to the respective emitter, a respective collector port electrically connected to the respective collector, a respective base port electrically connected to the respective base, and a respective non-linear device electrically connected between the respective input port and the respective collector;

connecting the respective base ports of each of the second electronic current equalization modules to the first collector port of the first electronic current equalization module; and connecting the first ground port of the first electronic current equalization module and the respective ground ports of each of the second electronic current equalization modules to a ground connection of the current source.

9. The method of claim 8, wherein connecting the outputs of each of the one or more respective secondary loads to the respective collector port of the corresponding one or more second electronic current equalization modules comprises:

connecting the outputs of each of the one or more respective secondary loads to the respective input port of the corresponding one or more second electronic current equalization modules; and mounting a respective short-circuit connection between the respective input port and the respective collector port of each of the second electronic current equalization modules.

* * * * *